United States Patent [19]

Post

[11] Patent Number: 4,576,337

[45] Date of Patent: Mar. 18, 1986

[54] ARRANGEMENT FOR OPERATING DUAL FLUID SYSTEMS

[75] Inventor: Steven W. Post, Jonesboro, Ark.

[73] Assignee: FMC Corporation, Chicago, Ill.

[21] Appl. No.: 583,519

[22] Filed: Feb. 24, 1984

[51] Int. Cl.[4] ..... B67D 5/365; B05B 9/00

[52] U.S. Cl. ..... 239/127; 239/197; 137/355.12; 137/355.2; 137/574

[58] Field of Search ..... 239/127, 195–197; 137/355.12, 355.2, 355.16, 574

[56] References Cited

U.S. PATENT DOCUMENTS

| | | | |
|---|---|---|---|
| 965,634 | 7/1910 | Judevine | 137/574 |
| 1,410,104 | 3/1922 | Lindsey, Jr. | 137/574 |
| 2,518,990 | 8/1950 | Keener | 239/197 |
| 3,037,707 | 6/1962 | Ligon | 239/127 X |
| 3,165,109 | 1/1965 | Hammelmann | 239/198 X |
| 3,910,497 | 10/1975 | Manor | 239/127 |

FOREIGN PATENT DOCUMENTS

| | | | |
|---|---|---|---|
| 2641638 | 3/1978 | Fed. Rep. of Germany | 239/197 |

*Primary Examiner*—Jeffrey V. Nase
*Assistant Examiner*—Mary Beth O. Jones
*Attorney, Agent, or Firm*—Ronald C. Kamp; Richard B. Megley

[57] ABSTRACT

A sewer cleaner having a water pump with a clutch-less connection to an engine draws water from a tank having a baffle with an orifice. A valve arrangement directs the output from the pump to either a hose on a reel or recirculates to the tank. The flow rate through the orifice is less than the operating output of the pump so that the recirculated water combines with that flowing through the orifice to permit operation of a hydraulic system to rotate the hose reel.

1 Claim, 1 Drawing Figure

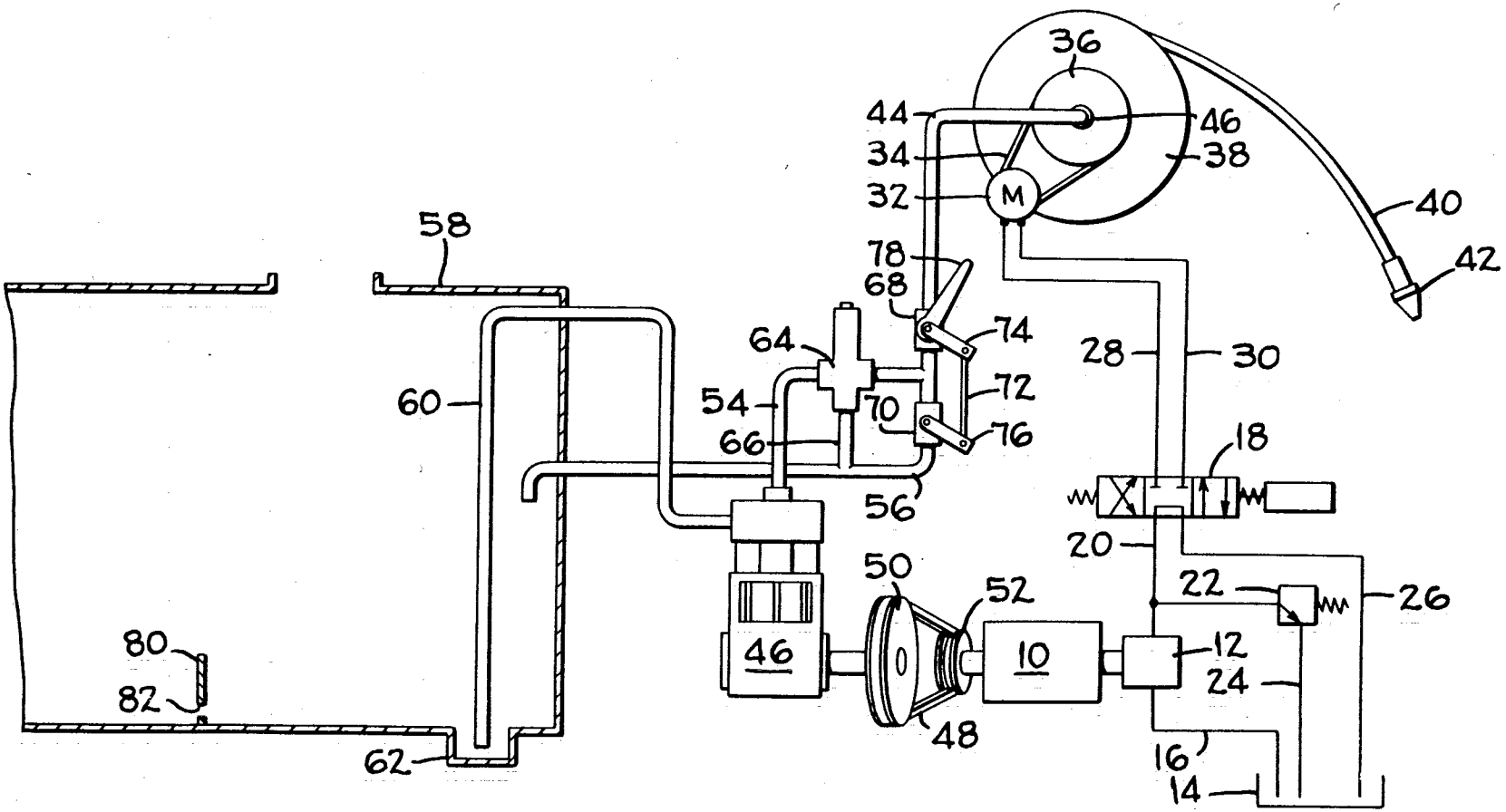
40
42
26
30
18
46
38
22
12
24
14
16
36
28
20
10
M
74
72
76
52
48
44
34
32
78
68
70
56
50
64
54
66
46
58
60
62
80
82

ARRANGEMENT FOR OPERATING DUAL FLUID SYSTEMS

This invention relates to an arrangment for operating two separate and independent fluid systems, one system being a closed loop and the other system normally being an open loop wherein its fluid is exhausted, with both systems being continuously powered by a common prime mover, and more particularly to such an arrangment adapted to provide a simple and economical sewer cleaner.

Conventional sewer cleaners remove debris from the interior of a sewer pipe by discharging a high pressure spray of water into the interior thereof. The high prssure spray impinges on the inner surfaces of the sewer pipe dislodging debris adhered thereto and the disloged debris is carried toward a low point in the sewage system in the low pressure water stream resulting from collection of the spray in the bottom of the pipe. The high pressure spray is provided by a water pump which draws water from a portable tank and discharges it through a nozzle on the free end of a flexible hose. The hose is initially wound on a rotatably mounted hose reel and is inserted through a manhole, or other suitable access port, into a sewer pipe and progressively fed into that pipe. The hose is pulled by the reaction resulting from discharge of the high pressure water from the nozzle aided by powered unreeling of the hose. The hose reel is powered by a hydraulic motor to which hydraulicc fluid pressure is supplied by a hydraulic pump arranged in a closed hydraulic fluid loop with the motor and a center off, directional contr0l valve. Both the water pump and hydraulic pump are driven by a common engine.

When the supply of water in the portable tank is exhausted, the water pump is disengaged from the engine and the directional control valve positioned to drive the hydraulic motor in a direction to reel in the hose. The portable tank, which typically is mounted on a truck chassis along with the other portions of the open loop water system, the closed loop hydraulic system and the engine, is then transported to a water supply for refilling. Since the packing in the water pump will be damaged if it is operated without a supply of water, a clutch is provided between the water pump and the engine. Disengagement of the drive to the water pump, permits the engine to drive the hydraulic pump in order to reel in the hose while permitting the water pump to remain idle thereby preventing any damage to the packing in the water pump.

The present invention permits the water pump to be continuously driven thereby eliminating the need for a clutch and its concomitant cost, maintenance and repair. Once the pump draws air in addition to water, it is necessary to reprime the pump. A reprime baffle is positioned across the bottom of the tank and is provided with an orifice positioned near the floor of the tank. The orifice is sized to provide a flow rate therethrough less than the output of the water pump. When the water in the tank is drawn below the inlet of the intake pipe 60, the water pump will begin to intake air, breaking the prime and providing an audible signal to the operator that the tank water is nearly exhausted. A low pressure recirculating valve is then opened to return pump flow to the tank and a valve is closed to prohibit discharge of water into the hose. The water thus recirculated will combine with the water discharged through the orifice to provide a sufficient volume of water for the water pump to reestablish its prime. The pump can thereafter be driven by the engine without damage while the hose is reeled in.

The sole FIGURE of drawing is a schematic representation of a sewer cleaner incorporating a preferred embodiment of the present invention.

Referring to the drawing, an engine 10 is directly connected to drive a hydraulic pump 12 which draws hydraulic fluid from a reservoir 14 through a conduit 16 and discharges it at high pressure to a manually controlled, directional valve 18 through conduit 20. A pressure relief valve 22 in conduit 24 limits the pressure supplied to the valve 18. Hydraulic fluid is returned to the reservoir 14 through conduit 26. A pair of conduits 28 and 30 are connected between the valve 18 and a hydraulic motor 32, which powers the hose reel 38 through a reduction drive, such as chain 34 trained over a small driven sprocket (not shown) on the output shaft of the motor 32 and a large sprocket secured to the rotatably mounted hose reel 38. Movement of the valve 18 in either direction from its center-off position, as illustrated in the drawing, will connect one of the conduits 28 and 30 with the pressure conduit 20 while simultaneously connecting the other of these conduits to the return conduit 26, thus determining the direction and speed of rotation of the hose reel 38. The hydraulic system, as above described, comprises a closed loop system and is basically conventional.

A hose having a discharge nozzle 42 on its free end is wound on the hose reel 38 and may be unwound therefrom and rewound thereon by selected positioning of the valve 18. A supply pipe 44 is connected to the hose 40 through a rotary fluid joint 46. Water under pressure is supplied to the conduit 44 by a positive displacement pump 46, which is continuously driven by a belt 48 trained over sheaves 50 and 52 attached to the input of pump 46 and the output of engine 10 respectively, through pipe 54. The return pipe 56 connects with both of the pipes 44 and 54 at their interconnection and discharges into a portable tank 58. The water pump 46 draws water from the tank 58 through an intake pipe 60 having its open end near the bottom of the tank sump 62. The pressure relief valve 64 in the pipe 54 limits the pressure in the water system by discharging excess fluid to the return pipe 56 through a pipe 66 connected between the valve 64 and pipe 56. A pair of valves 68 and 70, interposed in pipes 44 and 56 respectively are interconnected by a link 72 pivotally connected between operating levers 74 and 76 on the valve 68 and 70 respectively. A control lever 78 rotates the operating lever 74 and, through link 72, the operating lever 76 and is rotatable between two positions; one in which valve 68 is fully opened while valve 70 is fully closed and the other in which valve 68 is fully closed and valve 70 is fully open. Thus, the discharge pipe 54 is either in communication with the supply pipe 44 with the return pipe 56 blocked or in communication with return pipe 56 with the supply pipe 44 blocked.

During normal operation of the sewer cleaner, the valves 68 and 70 are positioned to provide the former of the above-described communication alternatives. In this condition, water is drawn from the tank 58 through intake pipe 60 by the pump 46 and discharged under high pressure through pipes 54 and 44 to the hose 40 for discharge through the nozzle 42. With valve 68 and 70 so positioned, the system may be defined as an open loop water system because the water is consumed or exhausted from the system.

A baffle 80 is affixed across the bottom of the tank 58 and is provided with an orifice 82. Water trapped behind the baffle 80, i.e. on the side of the baffle opposite the sump 62, can reach the open end of intake pipe 60 only by flowing through the orifice 82, which orifice is sized to provide a flow rate therethrough less than the discharge rate of the pump 46. The baffle 80, therefore, defines a volume of water to which the pump 46 has only restricted access as determined by the orifice 82. When water in excess of the defined volume has been consumed, the pump 46 will produce a different sound, which sound is associated with air being sucked into the intake or suction pipe, signalling the operator to reposition the control lever 78 so that the valve 68 is closed and the valve 70 is open, thereby blocking communication with the hose 40 while connecting pipe 54 free communication with the return pipe 56. When so positioned, the water flowing through the orifice 82 quickly provides a volume in the sump sufficient to reestablish the prime of pump 46 and the pump 46 thereafter can be driven indefinitely without any damage. Under these last described conditions, the water system has been converted to a closed loop water system.

It will be appreciated that the baffle and orifice and the valve 68 and 70 cooperate to reestablish the water pump in a closed loop system in order to permit indefinate operation of the water pump without damage thereto. The need for an expensive clutch, which is subject to wear, necessitating periodic adjustment and maintenance, to disengage the water pump from the engine is eliminated by the present invention. By comparison, the structure of the present invention is relatively inexpensive to manufacture and easy to maintain.

While a preferred embodiment for the present invention has been illustrated and described herein, various modifications and changes may be made therein without departing from the spirit of the invention as defined by the scope of the the appended claims.

What is claimed is:

1. In a sewer cleaner having an engine, a water tank, a hose reel, a water pump having an operating output connected to draw water from said tank, and a hydraulic pump and motor connected to rotate the hose reel in either direction, drive means uninterruptably connected to said engine and said pumps to continuously drive both of said pumps, supply and return conduits connecting said water pump to said hose reel and said tank respectively, and valve means in said conduits and having a supply position in which said output is directed only to said hose reel and a recirculate position in which said output is directed only to said return conduit; the improvement comprising:

a baffle having a continuously open orifice in the bottom of said tank, the orifice having a cross sectional area to restrict flow therethrough to a rate less than said output; whereby when operating with said valve means in said supply position and said water pump breaks its prime, moving said valve means to its recirculate position permits the rescirculated water to combine with the water discharged through said orifice to provide water volume sufficeint to re-establish prime to said water pump.

* * * * *